US012668886B2

(12) United States Patent
Han et al.

(10) Patent No.: US 12,668,886 B2
(45) Date of Patent: Jun. 30, 2026

(54) LITHIUM CATION EXCHANGE MEMBRANE FOR WATER ELECTROLYSIS, AND WATER ELECTROLYSIS SYSTEM USING SAME

(71) Applicant: BOYAZ ENERGY, Seoul (KR)

(72) Inventors: Sang-Beom Han, Seoul (KR); Yong-Hwan Mo, Incheon (KR); Yong-Soo Lee, Bucheon-si (KR)

(73) Assignee: BOYAZ ENERGY, Seoul (KR)

( * ) Notice: Subject to any disclaimer, the term of this patent is extended or adjusted under 35 U.S.C. 154(b) by 635 days.

(21) Appl. No.: 18/019,097

(22) PCT Filed: Jul. 1, 2021

(86) PCT No.: PCT/KR2021/008336

§ 371 (c)(1),
(2) Date: Feb. 1, 2023

(87) PCT Pub. No.: WO2022/030761

PCT Pub. Date: Feb. 10, 2022

(65) Prior Publication Data

US 2023/0313396 A1 Oct. 5, 2023

(30) Foreign Application Priority Data

Aug. 7, 2020 (KR) ..... 10-2020-0099209

(51) Int. Cl.
*C25B 9/19* (2021.01)
*C25B 1/04* (2021.01)
(Continued)

(52) U.S. Cl.
CPC ..... *C25B 13/08* (2013.01); *C25B 1/04* (2013.01); *C25B 9/19* (2021.01); *C25B 11/071* (2021.01); *C25B 15/08* (2013.01)

(58) Field of Classification Search
None
See application file for complete search history.

(56) References Cited

U.S. PATENT DOCUMENTS 4,389,494 A * 6/1983 Suhara ..... C08J 5/2206 521/27
2008/0264780 A1* 10/2008 Kato ..... C25B 11/031 204/252

(Continued)

FOREIGN PATENT DOCUMENTS

JP 2005-329375 A 12/2005
JP 2006-257452 A 9/2006

(Continued)

OTHER PUBLICATIONS

Li et al., Immobilization of Ni3Co nanoparticles into N-doped carbon nanotube/nanofiber integrated hierarchically branched architectures toward efficient overall water splitting, Advanced Science, 7, Jan. 1, 2020 (Year: 2020).*

(Continued)

*Primary Examiner* — Stefanie S Wittenberg
(74) *Attorney, Agent, or Firm* — Revolution IP, PLLC

(57) ABSTRACT

The present invention relates to a lithium cation exchange membrane, for water electrolysis, having high lithium cation conductivity, and a water electrolysis system using same, and a water electrolysis system using a lithium cation exchange membrane (LEM) for water electrolysis according to the present invention, comprising a hydrophilic polymer solution and a monomer solution having a sulfonic acid group, is an economically feasible water electrolysis system achieving lower costs than conventional proton exchange membrane (PEM) water electrolysis and a higher current density than alkali water electrolysis.

7 Claims, 9 Drawing Sheets

(51) Int. Cl.

| | |
|---|---|
| ***C25B 11/071*** | (2021.01) |
| ***C25B 13/08*** | (2006.01) |
| ***C25B 15/08*** | (2006.01) |

(56) References Cited

U.S. PATENT DOCUMENTS

| | | | | |
|---|---|---|---|---|
| 2016/0312371 | A1 | 10/2016 | Kamei et al. | |
| 2017/0362717 | A1* | 12/2017 | Hattori | C01F 17/30 |
| 2021/0371995 | A1* | 12/2021 | Funakawa | C25B 11/02 |

FOREIGN PATENT DOCUMENTS

| | | | | |
|---|---|---|---|---|
| JP | 2015-117407 | A | 6/2015 | |
| KR | 10-1859871 | B1 | 5/2018 | |
| WO | 2007-082898 | A2 | 7/2007 | |
| WO | WO-2020059627 | A1 * | 3/2020 | C25B 11/063 |

OTHER PUBLICATIONS

International Search Report for PCT/KR2021/008336 mailed Oct. 12, 2021 from Korean Intellectual Property Office.

* cited by examiner

[FIG. 1]
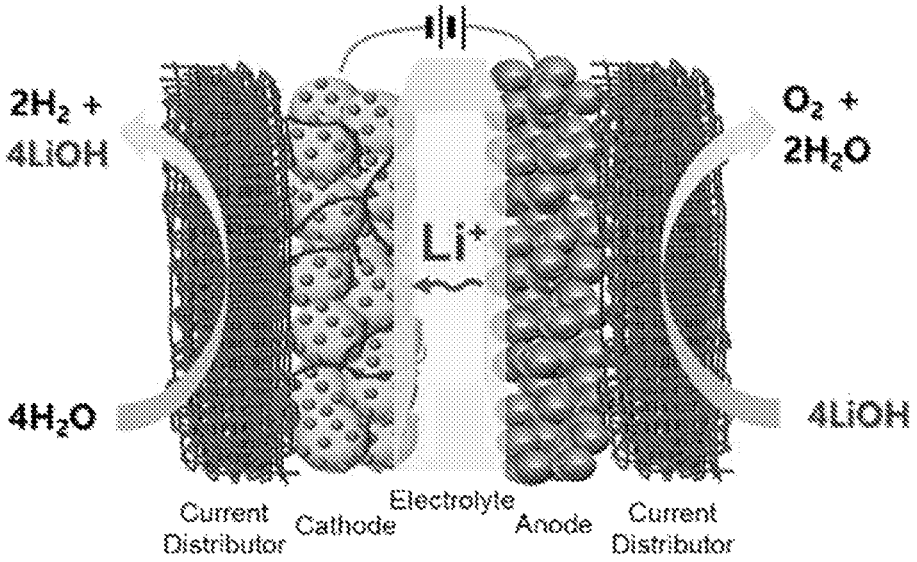

[FIG. 2]

| | Solvents | Boiling point | Apparatus | Nafion | | Binder | | |
|---|---|---|---|---|---|---|---|---|
| | | | | Fuel cell store R 1000 | Fuel cell store NR 40 | Polysulfone | P123 | PVA |
| Solvents & Instruments | Water | 100 ℃ | Paste mixer | X | X | X | O | X |
| | | | Sonicator | X | X | X | O | X |
| | | | Heater | X | - | X | - | O |
| | EtOH | 78 ℃ | Paste mixer | X | X | X | - | X |
| | | | Sonicator | X | X | X | - | X |
| | | | Heater | X | - | X | - | X |
| | IPA | 83 ℃ | Paste mixer | X | X | X | - | X |
| | | | Sonicator | X | X | X | - | X |
| | | | Heater | - | X | X | - | X |
| | NMP | 202 ℃ | Paste mixer | X | X | X | - | X |
| | | | Sonicator | X | X | O | - | X |
| | | | Heater | O | O | O | - | X |
| | MEK | 80 ℃ | Paste mixer | - | X | X | - | X |
| | | | Sonicator | - | X | X | - | X |
| | | | Heater | - | - | X | - | X |
| | tert -Butanol | 83 ℃ | Paste mixer | - | X | X | - | X |
| | | | Sonicator | - | X | X | - | X |
| | | | Heater | - | - | X | - | X |
| | DMA | 165 ℃ | Paste mixer | - | X | X | - | X |
| | | | Sonicator | - | X | O | - | X |
| | | | Heater | - | O | - | - | O |

[FIG. 3]

| | | Binder | | | |
|---|---|---|---|---|---|
| | Polymer (Solvent) | Polysufone (NMP) | Polysufone (DMA) | P123 (distilled water) | PVA (distilled water) |
| Nafion | NR 40 (NMP) | - | O | - | O |
| | NR 40 (DMA) | - | O | - | O |
| | Nafion solution (IPA) | X | X | O | O |
| | | Hot plate | | Hot plate, XY Spray | |

[FIG. 4]
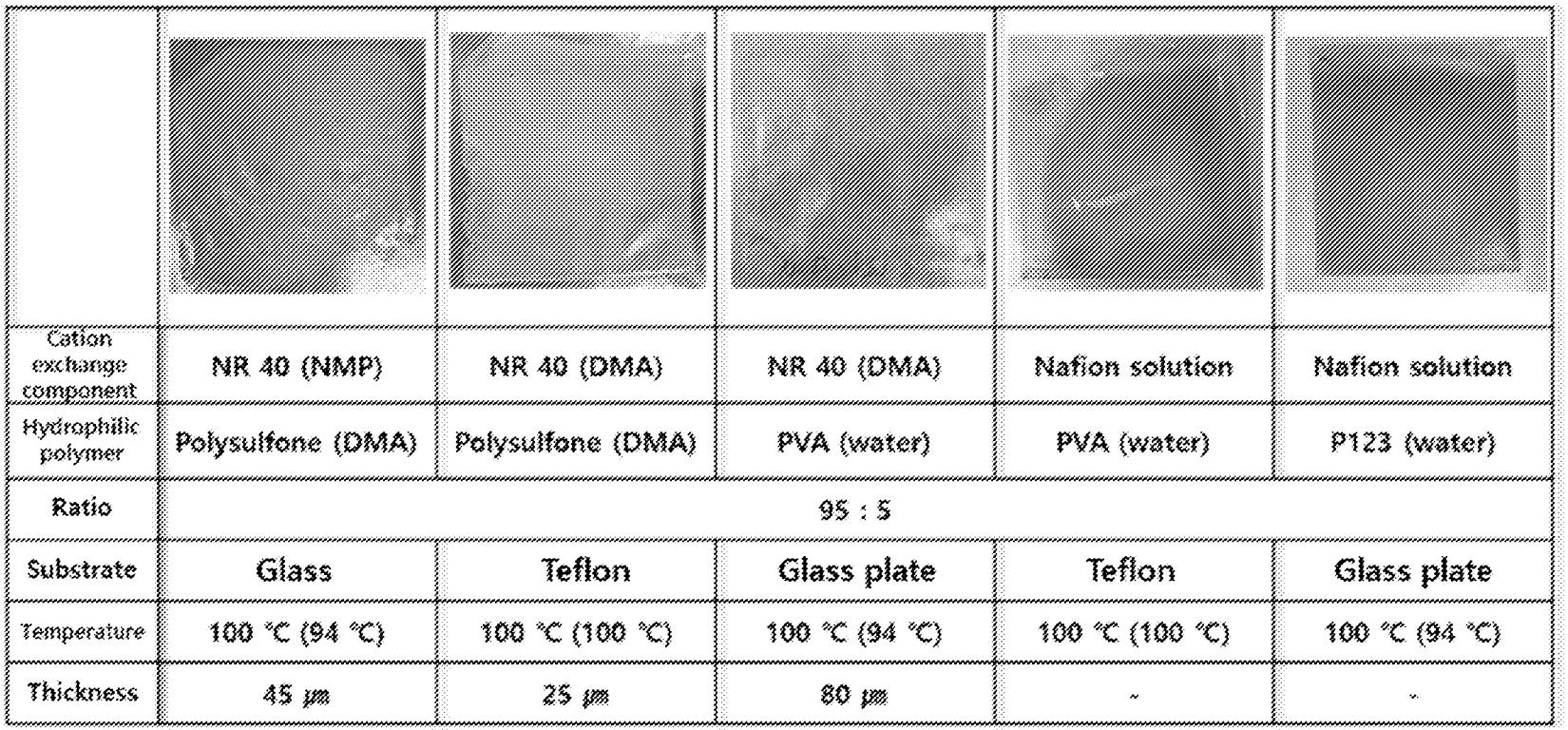
| | | | | |
|---|---|---|---|---|
| Cation exchange component | NR 40 (NMP) | NR 40 (DMA) | NR 40 (DMA) | Nafion solution |
| Hydrophilic polymer | Polysulfone (DMA) | Polysulfone (DMA) | PVA (water) | PVA (water) | P123 (water) |
| Ratio | 95 : 5 | | | |
| Substrate | Glass | Teflon | Glass plate | Teflon | Glass plate |
| Temperature | 100 °C (94 °C) | 100 °C (100 °C) | 100 °C (94 °C) | 100 °C (100 °C) | 100 °C (94 °C) |
| Thickness | 45 μm | 25 μm | 80 μm | - | - |

[FIG. 5]
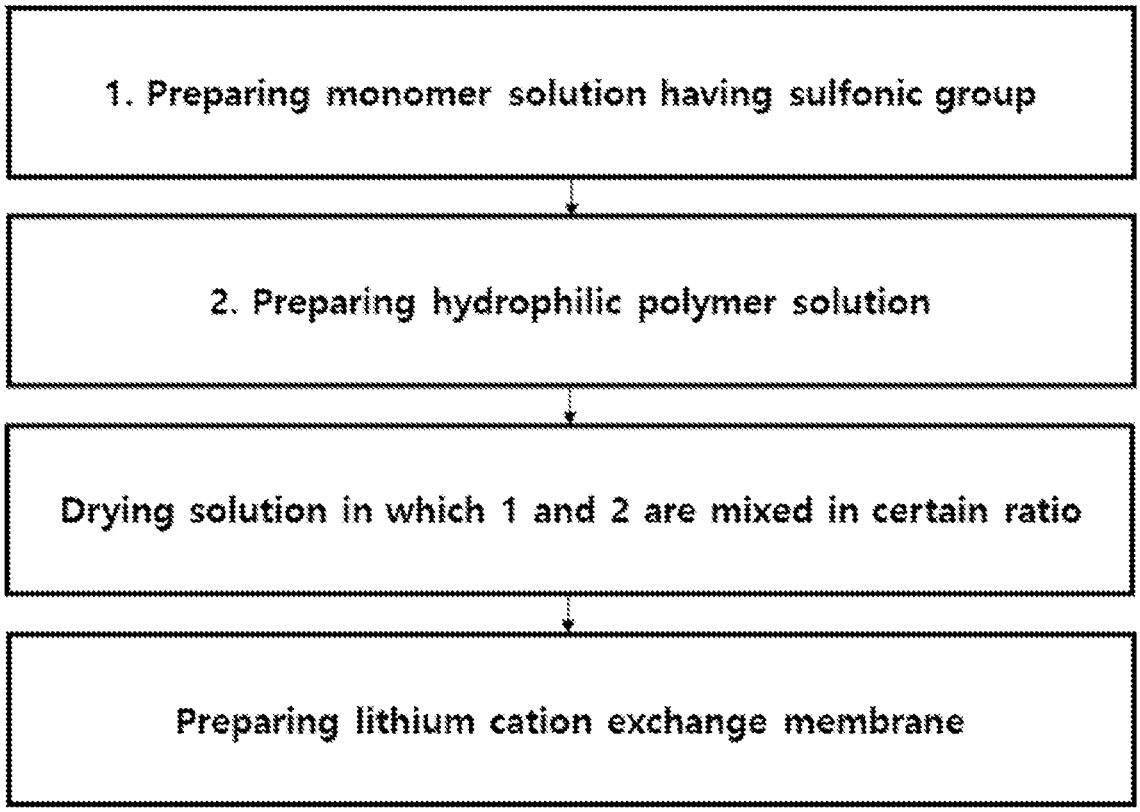

[FIG. 6]
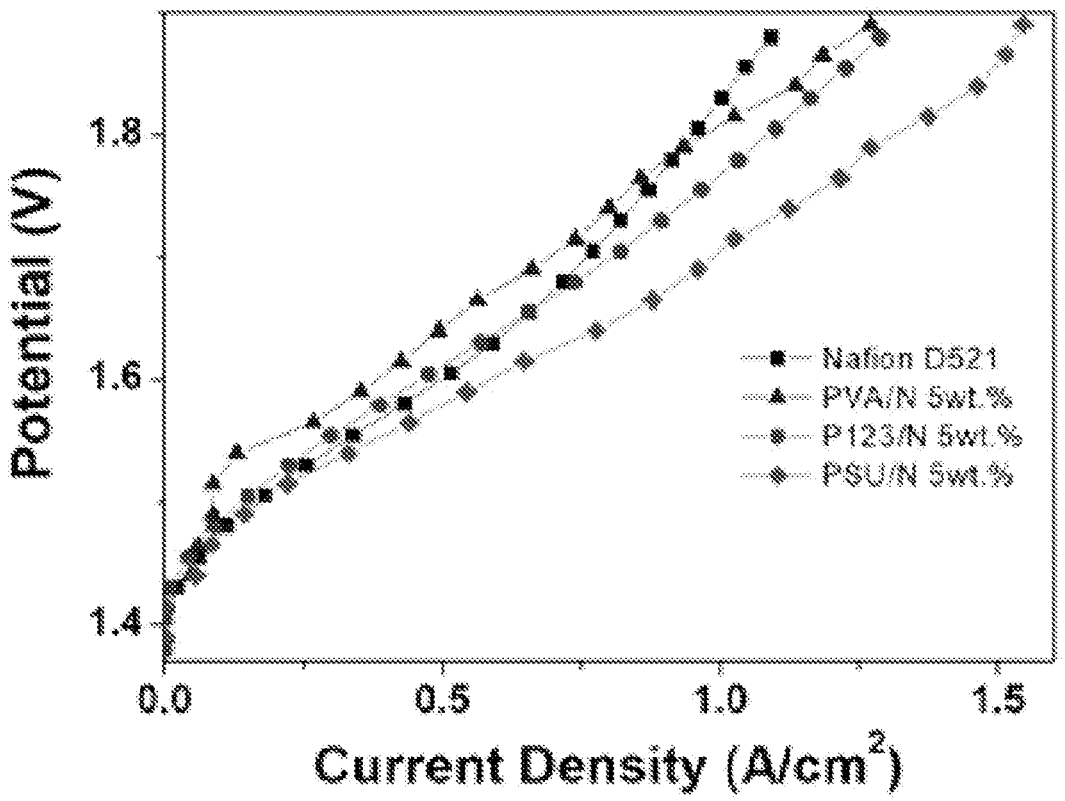

[FIG. 7]
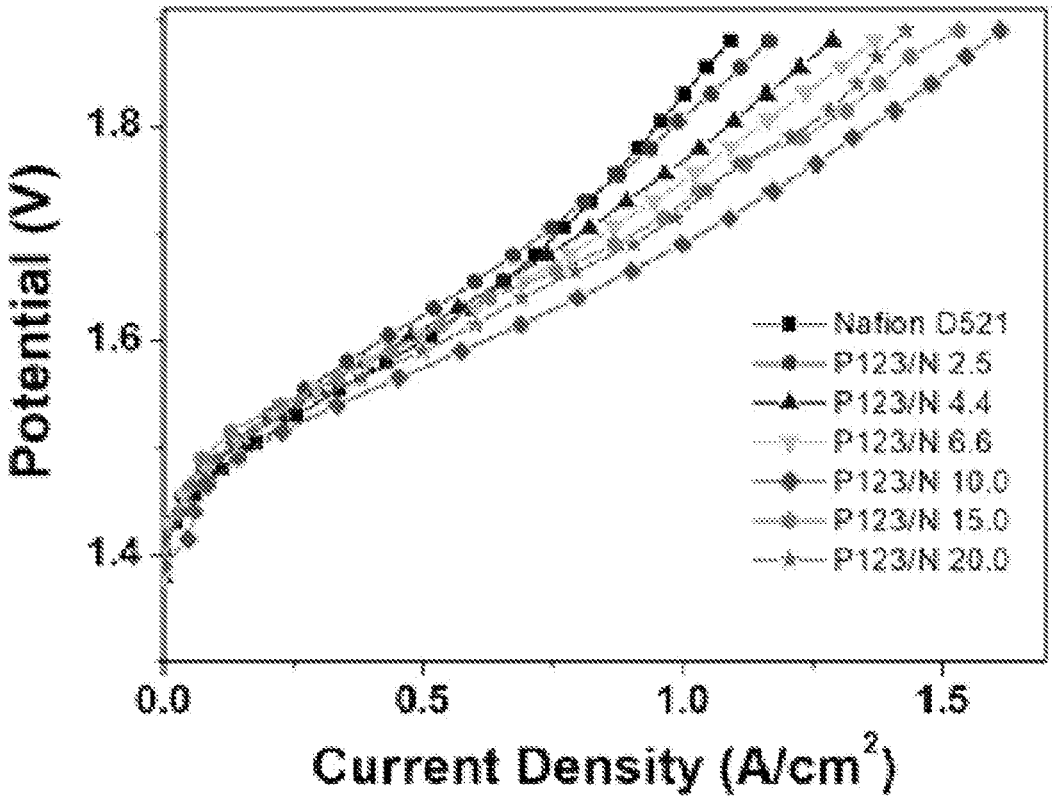

[FIG. 8]
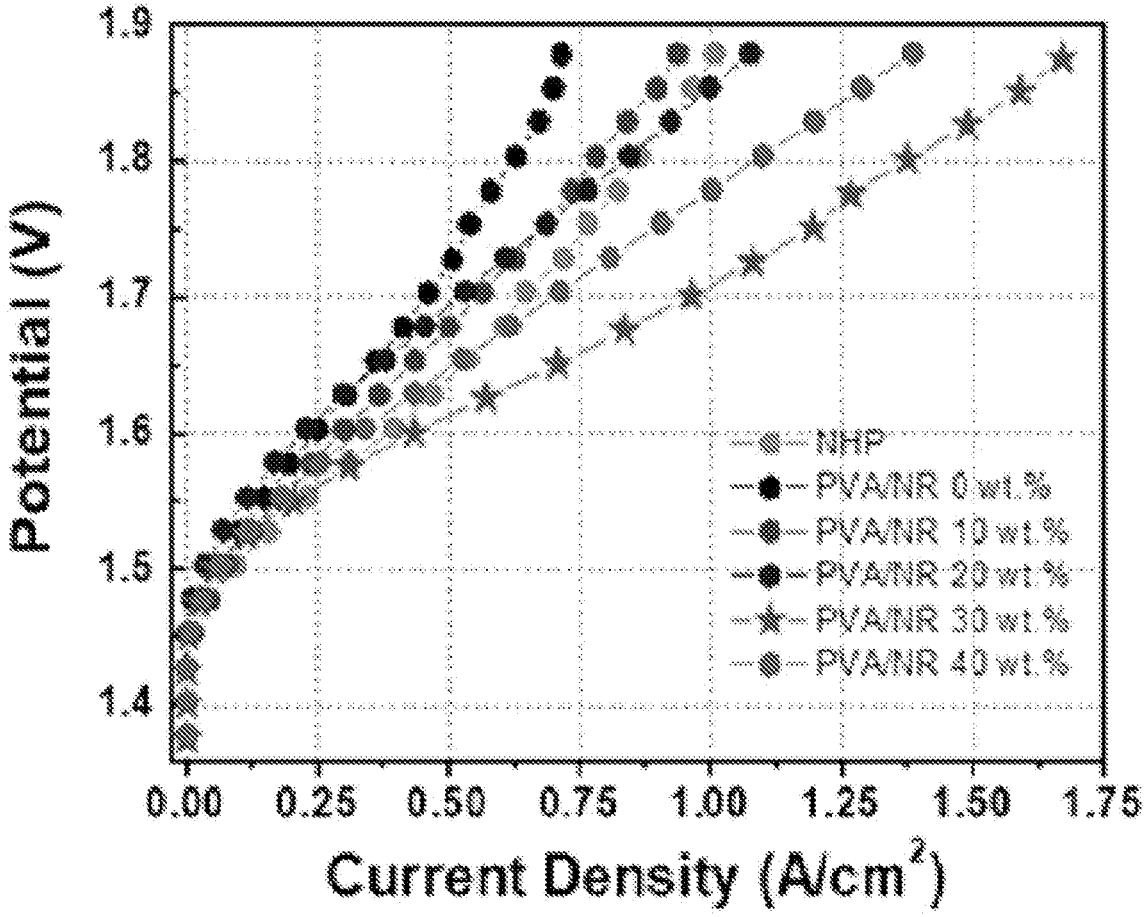

[FIG. 9]
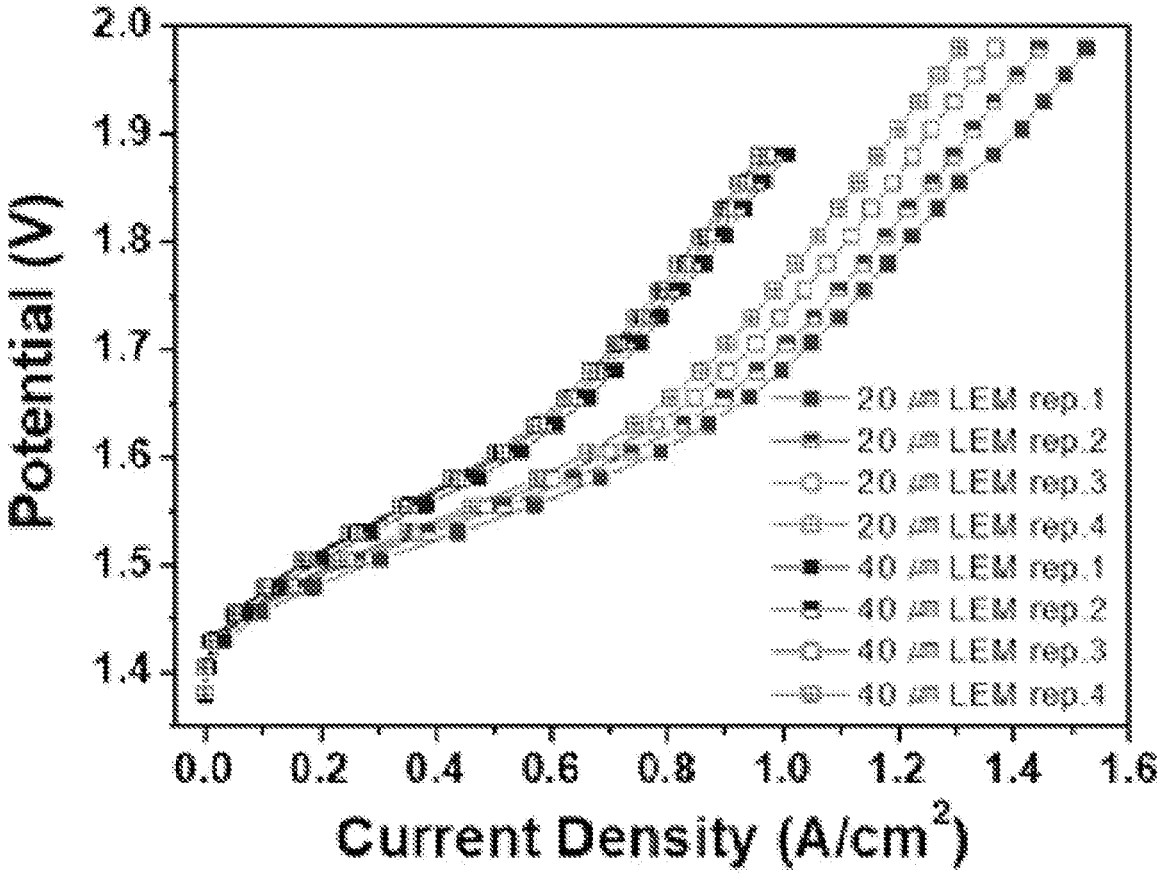

LITHIUM CATION EXCHANGE MEMBRANE FOR WATER ELECTROLYSIS, AND WATER ELECTROLYSIS SYSTEM USING SAME

CROSS REFERENCE TO PRIOR APPLICATIONS

This application is the 35 U.S.C. 371 national stage of International application PCT/KR2021/008336 filed on Jul. 1, 2021; which claims priority to Korean Patent Application No. 10-2020-0099209 filed on Aug. 7, 2020. The entire contents of each of the above-identified applications are hereby incorporated by reference.

TECHNICAL FIELD

The present disclosure relates to a lithium cation exchange membrane for water electrolysis with high lithium ion conductivity, and a water electrolysis system using the same and, more specifically, a water electrolysis system using a lithium cation exchange membrane (LEM) for water electrolysis with high lithium ion conductivity, including a monomer solution having a sulfonic acid group and a hydrophilic polymer solution according to the present disclosure.

BACKGROUND ART

Recently, with the trend of commercialization of fuel cells using hydrogen, a method of producing hydrogen as a fuel has been highlighted. Of the hydrogen generation methods, the value of a clean energy production method to generate hydrogen using electric energy is becoming important. The raw material for producing hydrogen is water ($H_2O$), and the hydrogen ($H_2$) and oxygen ($O_2$) produced thereby are not substances causing environmental pollution without producing byproducts, thereby securing values as an eco-friendly alternative energy.

Typical technologies of water electrolysis may be broadly divided into three categories: 1) A proton exchange membrane (PEM) water electrolysis method using a cation exchange membrane, 2) an alkaline electrolysis (AE) method using alkaline electrolyte, and 3) a high temperature electrolysis (THE) method with ceramic electrolyte applied in the presence of high temperature water vapor.

Catalysts used for the proton exchange membrane (PEM) water electrolysis listed in the first place include noble metals such as Pt and Pd, characterized by having high current density due to high hydrogen ion conductivity (more than 1 A/cm$^2$). However, the use of noble metals causes the cost increase for constructing apparatuses, such that the technology has not been widely commercialized.

On the other hand, the existing alkaline water electrolysis technology listed in the second place that uses a low-cost catalyst such as Ni has been commercialized and widely used, but the current density is as low as 0.4 A/cm$^2$ or less. In addition, the purity of hydrogen is low due to the high hydrogen permeability of a diaphragm, and the current efficiency sharply drops at a low current density.

The third HTE method is a method using an electrolyte with ceramic ions applied while having a current density of 1 A/cm$^2$ or more, like PEM, but operating temperature thereof is 700° C. or higher to make it difficult to operate in a small system while commercialization is slow due to a difficulty in securing durability of materials that stand high temperature operation.

As such, there are various water electrolysis methods, and in order to activate the hydrogen economy, a technology capable of lowering the cost of the water electrolysis apparatus while increasing a current density is required.

DISCLOSURE OF THE INVENTION

Technical Goals

Since conventional alkaline water electrolysis causes a problem concerning low current density while cation exchange membrane-based PEM water electrolysis also has an issue of high price by using noble metal catalysts, an object of the present disclosure is to provide an LEM water electrolysis system in which the overall performance of a water electrolysis apparatus is enhanced by increasing conductivity of lithium ions in a lithium cation exchange membrane, thereby ensuring improved energy efficiency.

Technical Solutions

In order to achieve the above object, the present disclosure provides a lithium cation exchange membrane (LEM) for water electrolysis, including a monomer solution having a sulfonic acid group and a hydrophilic polymer solution.

In addition, the present disclosure provides an LEM water electrolysis system including a cation exchange membrane including the lithium cation exchange membrane (LEM) for water electrolysis; an anode coming in contact with or bonded to one surface of the cation exchange membrane; and a cathode coming in contact with or bonded to the other surface of the cation exchange membrane.

Advantageous Effects

The present disclosure relates to a lithium cation exchange membrane with high lithium ion conductivity and a water electrolysis system using the same. While a conventional alkaline water electrolysis-based water electrolysis apparatus shows hydrogen production-driven current density of ~0.45 A/cm$^2$, the lithium cation exchange membrane according to the present disclosure has an enhanced current density by elevating the transfer rate of lithium ions in lithium hydroxide, and the elevated current density at the same voltage increases an amount of hydrogen generated per second, such that the water electrolysis system using the lithium cation exchange membrane according to the present disclosure may provide a water electrolysis system with highly improved performance compared to alkaline water electrolysis and also reduce system cost compared to the conventional PEM water electrolysis.

BRIEF DESCRIPTION OF DRAWINGS

FIG. 1 is a schematic diagram of an LEM water electrolysis system according to the present disclosure.

FIGS. 2 to 4 show a process of selecting a solvent, a binder, and a hydrophilic polymer for manufacturing a lithium cation exchange membrane according to the present disclosure.

FIG. 5 is a flow chart illustrating a manufacturing process of a lithium cation exchange membrane according to the present disclosure.

FIGS. 6 to 8 show results of electrochemical performance evaluation for MEA according to Examples 1 to 3.

FIG. 9 shows a result of preparing MEA having a thickness of 20 μm using ultrasonic spray.

BEST MODE FOR CARRYING OUT THE INVENTION

Hereinafter, the present disclosure will be described in more detail.

As a result of earnest efforts to develop a water electrolysis system with current density improved even with a use of a low-cost catalyst used in the conventional alkaline water electrolysis, the present inventors completed the present disclosure by finding that a lithium cation exchange membrane (LEM) for water electrolysis including a monomer solution having a sulfonic acid group and a hydrophilic polymer solution increases the transfer rate of lithium cation and elevates the current density as well as production rate of hydrogen.

Accordingly, the present disclosure provides a lithium cation exchange membrane (LEM) for water electrolysis, including a monomer solution having a sulfonic acid group and a hydrophilic polymer solution.

Conventional membranes poorly facilitate the passage of hydrogen ions and lithium ions to cause an issue of lowering the current density, but, according to an example embodiment of the present disclosure, it is possible to provide a lithium cation exchange membrane in which an exchange path for hydrogen cations or lithium cations is created by forming a channel by self-assembly of sulfonic acid groups ($—SO_3^-$) included in Nafion so as to increase hydrogen generation rate owing to the ion transfer rate elevated thereby while being usable in a more improved water electrolyte system.

In the present disclosure, the monomer having the sulfonic acid group may be a fluorine-based monomer having a sulfonic acid group, and as an example embodiment, it may be a perfluorosulfonic acid (PFSA)/polytetrafluoroethylene (PTFE) copolymer, but is not limited thereto.

In the present disclosure, the hydrophilic polymer may be an alcohol-based polymer, a sulfone-based polymer, or an ether-based polymer, including, as an example embodiment, pluoric 123 (P123), polyvinyl alcohol (PVA), polysulfone (PS), polyethylen glycol (PEG), 2-hydroxyethyl methacrylate (HEMA), 2-hydroxyethyl acrylate (HEA), ethylene glycol dimethacrylate, methylene-bis-acrylamide or poly(1,1-dihydroperfluorooctylacrylate) (PFOA), but is not limited thereto.

The mass ratio of the hydrophilic polymer to the monomer having the sulfonic acid group may be 100:(3-40), preferably 100:(4-20), more preferably 100:(5-15). Here, if the mass ratio is out of the above ratio, it is difficult to dissolve the hydrophilic polymer in a solvent, which may cause a failure in the membrane formation due to the non-uniformity. As an example embodiment, as a result of progression with the mass of the hydrophilic polymer set to 50 wt. % compared to the monomer having the sulfonic acid group, the membrane formation failed such that the performance test could not be performed.

In addition, the present disclosure provides a lithium cation exchange membrane (LEM) water electrolysis system including a cation exchange membrane including the LEM for water electrolysis; an anode coming in contact with or bonded to one surface of the cation exchange membrane; and a cathode coming in contact with or bonded to the other surface of the cation exchange membrane.

In the LEM water electrolysis system according to the present disclosure, lithium hydroxide electrolyte may be supplied to the anode, and lithium hydroxide may be generated in the cathode.

Here, the lithium hydroxide electrolyte according to the present disclosure may supply an aqueous solution having a concentration of 1 to 15 wt %, and the lithium hydroxide generated in the cathode may move to an electrolyte supply storage in the anode.

In addition, the anode and the cathode may include an electrode body and a binder in the electrode body, respectively. Preferably, the anode may include an anode catalyst in the binder and be bonded to one surface of the cation exchange membrane, and the cathode may include a cathode catalyst in the binder and be bonded to the other surface of the cation exchange membrane.

In this case, the anode catalyst may include $Ni_3Co$ alloy nanoparticles, and the anode may be formed on one surface of the cation exchange membrane by using a catalyst solution in which the NiCo alloy nanoparticles are mixed in the binder, wherein the $Ni_3Co$ alloy nanoparticles may be mixed in an amount of 1 to 20 wt % with respect to 100 wt % of the binder.

In addition, the cathode catalyst may include Ni-based nanoparticles, and the cathode may be formed on the other surface of the cation exchange membrane by using a catalyst solution in which the Ni-based nanoparticles are mixed in the binder, wherein the Ni-based nanoparticles may be mixed in an amount of 1 to 20 wt % with respect to 100 wt % of the binder.

Here, the binder may be selected from the group consisting of polyvinylidene fluoride, polyvinylidene fluoride-hexafluoropropylene, and a mixture including them.

In the present disclosure, the anode or cathode and the cation exchange membrane may be prepared by pressing via a hot-press process, preferably by pressing under hot-press conditions of 1 to 10 MPa at 90 to 150° C. for 1 to 10 minutes, but is not limited thereto.

The water electrolysis system according to an example embodiment of the present disclosure is formed of a membrane electrode assembly (MEA) for water electrolysis including a pair of catalyst electrodes formed by including a catalyst material and a cation exchange membrane interposed between the pair of catalyst electrodes, and more specifically, it may include an anode catalyst electrode formed of $Ni_3Co$ nanoparticles and a binder, a cathode catalyst electrode formed of Ni nanoparticles and a binder, and a lithium cation exchange membrane interposed between the anode catalyst electrode and the cathode catalyst electrode, wherein an electrolyte of an aqueous lithium hydroxide solution may be supplied to the anode catalyst electrode.

In the water electrolysis system according to an example embodiment of the present disclosure, the anode catalyst electrode may be prepared by applying a catalyst ink mixed with $Ni_3Co$ nanoparticles and polyvinylidene fluoride-hexafluoropropylene to a lithium cation exchange membrane via an ultrasonic spray method, and the cathode catalyst electrode may be prepared by applying Ni nanoparticles to the lithium cation exchange membrane in the same way as the anode catalyst electrode, wherein the method of applying the catalyst ink to the lithium cation exchange membrane may be applied without limitation unless it is a method of applying the catalyst ink to the ion exchange membrane such as spraying, casting, printing, rolling, or brushing.

A lithium cation exchange membrane (LEM) water electrolysis system using the lithium hydroxide electrolyte according to the present disclosure will be described in detail below.

In general, alkaline water electrolysis generates hydrogen and oxygen using electric energy as shown in the following Reaction Scheme 1 and 2. As shown in Reaction Scheme 1, $OH^-$ ions generated in the cathode may move to the anode through an anion exchange membrane or a diaphragm, and alkali cations may also move when the diaphragm is used. In particular, most commercial alkaline water electrolysis uses the diaphragm which is inexpensive but has low ion conductivity, and it also has low current density due to high hydrogen permeability as well as low hydrogen purity.

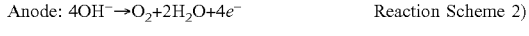

Cathode: $4H_2O+4e^- \rightarrow 2H_2+4OH^-$ Reaction Scheme 1)

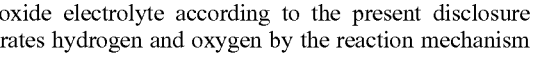

Anode: $4OH^- \rightarrow O_2+2H_2O+4e^-$ Reaction Scheme 2)

The LEM water electrolysis system using the lithium hydroxide electrolyte according to the present disclosure generates hydrogen and oxygen by the reaction mechanism shown in the following Reaction Scheme 3 and 4 as shown in FIG. 1. Specifically, LiOH (lithium hydroxide) supplied to the anode generates oxygen and four $Li^+$ ions which move to the cathode through the lithium exchange membrane and then encounter electrons and water to generate hydrogen and lithium hydroxide. The aqueous lithium hydroxide solution generated in the cathode may be re-supplied to an anode electrolyte tank after being separated from hydrogen gas so as to be reused.

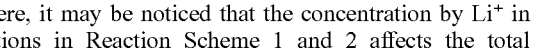

Anode: $4LiOH \rightarrow O_2+2H_2O+4Li^++4e^-$ Reaction Scheme 3)

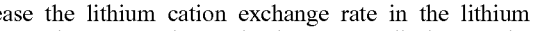

Cathode: $4Li^++4e^-+4H_2O \rightarrow 2H_2+4LiOH$ Reaction Scheme 4)

Here, it may be noticed that the concentration by $Li^+$ in reactions in Reaction Scheme 1 and 2 affects the total generation amount of hydrogen and oxygen. In an attempt to increase the lithium cation exchange rate in the lithium cation exchange membrane, in the present disclosure, the lithium cation exchange rate is increased by using a hydrophilic polymer such as an alcohol-based polymer, a sulfone-based polymer, or an ether-based polymer, and the increased lithium cation concentration becomes a factor that elevates the hydrogen production rate according to Le Chatelier's principle in the Reaction Scheme.

Modes for Carrying Out the Invention

Hereinafter, to help the understanding of the present disclosure, example embodiments will be described in detail. However, the following example embodiments are provided to more completely explain the present disclosure to those with average knowledge in the art and are only illustrative of the contents of the present disclosure, so that the scope of the present disclosure is not limited to the following example embodiments.

<Preparation Example 1> Preparation of Membrane Formation for a Lithium Cation Exchange Membrane According to the Present Disclosure Due to poor movement of lithium cations in the Nafion that is mainly used in the conventional water electrolysis system to serve as a channel for movement of hydrogen ions, a Nafion source, a hydrophilic polymeric binder, and an appropriate solvent were mixed to increase the size of the channel of Nafion serving as a cation exchange ionomer, and a cation exchange ionomer, a hydrophilic polymer, and a solvent were first selected to develop a lithium cation exchange membrane optimized for the movement of lithium ions.

As shown in FIG. 2, a number of solvents were used, Nafion™ R-1000 and Nafion™ NR-40 of Chemours were used as the Nafion source, and examination was performed respectively using pluoric 123 (P123), polyvinyl alcohol, or polysulfone (PS) as a binder.

FIG. 3 shows a result of ultrasonic spray performed among the mixable materials of which PS may not be used while two exchange membranes were finally prepared, wherein the first one is a case when Nafion solution and P123 binder were used, and the second one is a case when NR 40 was used as the Nafion source in a DMA solvent as well as a PVA binder.

FIG. 4 shows a usable substrate in that PS, PVA, and P123 were used, an appropriate solvent was found and marked, and transfer was performed using ultrasonic spray, wherein PS was able to be sprayed for exchange membrane preparation, but MEA preparation failed due to reactions with materials coming in contact with.

Therefore, MEA was finally prepared with two exchange membranes which include a sample prepared by adding the hydrophilic polymer PVA to a solution in which NR 40 was dissolved in DMA solvent and a sample prepared by adding the hydrophilic polymer P123 in the Nafion solution.

<Example 1> Preparation of the Lithium Cation Exchange Membrane and MEA According to the Present Disclosure—FIG. 6

The lithium cation exchange membrane according to the present disclosure was prepared according to the flow chart shown in FIG. 5. More specifically, a homogenous (5 wt % hydrophilic polymer/$H_2O$ base) solution A was prepared, in which pluoric 123 (P123), polyvinyl alcohol (PVA), or polysulfone (PS) was dissolved in purified water for 24 hours. Solution B of commercial D521 Nafion solution (5 wt % Nafion/EtOH base) was prepared. The solution A and solution B were mixed in a ratio of 5:95 (wt %, P123/N, PVA/N, PS/N) and diffused with ultrasonic waves. The uniformly mixed ink was sprayed in a size of 5×5 $cm^2$ using ultrasonic spray to prepare a membrane. The thickness of the membrane was determined by controlling the Nafion ionomer/solvent ratio of the ink and the repetition number of spray.

As shown in FIG. 1, the LEM water electrolysis system according to the present disclosure consists of an anode, a lithium cation exchange membrane, and a cathode. To prepare a membrane electrode assembly (MEA) for LEM water electrolysis, an anode catalyst electrode was prepared by applying the catalyst ink in which 10 nm $Ni_3Co$ nanoparticles and a polyvinylidene fluoride-hexafluoropropylene binder are mixed in ethanol to one surface of the prepared lithium cation exchange membrane using an ultrasonic spray and drying the catalyst ink thereafter, and a cathode catalyst electrode was prepared by applying 10 nm Ni nanoparticles on the opposite surface of the lithium cation exchange membrane in the same manner as the anode catalyst electrode and drying the Ni nanoparticles thereafter. Preparation was conducted by setting the mixing ratio of $Ni_3Co$ nanoparticles or Ni nanoparticles to the binder to 4 wt % based on the dry weight of the binder.

Thereafter, the prepared MEA was put into a unit cell with a flow path and coupled to a single cell to prepare an LEM water electrolysis unit cell. The LEM water electrolysis unit cell was prepared to have the active area of 5 $cm^2$.

<Example 2> Preparation of the Lithium Cation Exchange Membrane and MEA According to the Present Disclosure—FIG. 7

As in Example 1, solution A (5 wt % Nafion solution, D521) was prepared, and solution B was prepared by stirring P123 using a purified water solvent for 24 hours to prepare a solution with a concentration of 5 wt %. The prepared solutions A and B were mixed at a mass ratio of P123 to Nafion (P123/N) at 2.5/97.5, 4.4/95.6, 6.6/93.4, 10/90, 15/85, and 20/80, respectively, and then ultrasonically diffused. The name of the sample was marked using the P123 value. (Example: P123/N 2.5) The membrane was prepared by using the uniformly mixed ink by ultrasonic spray. The thickness of the membrane was determined by controlling the Nafion ionomer/solvent ratio of the ink and the repetition number of spray. MEA was prepared in the same manner as in Example 1 using the lithium cation exchange membrane prepared by the above preparation method in a unit cell having a flow path, and the LEM water electrolysis unit cell was prepared by coupling the LEM water electrolysis unit cell to a single cell. The LEM water electrolysis unit cell was prepared to have the active area of 5 $cm^2$.

<Example 3> Preparation of the Lithium Cation Exchange Membrane and MEA According to the Present Disclosure As in Preparation Example 1, commercial Nafion™ NR-40 of Chemours was diluted in an ethanol solvent. 10 wt. %, 20 wt. %, 30 wt. %, 40 wt. %, and 50 wt. % of PVA were added respectively to the prepared solution in a mass ratio (PVA/N) to Nafion and were ultrasonically diffused. The membrane was prepared using the uniformly mixed ink by ultrasonic spraying. The thickness of the membrane was determined by controlling the Nafion ionomer/solvent ratio of the ink and the repetition number of spray. MEA was prepared in the same manner as in Example 1 using the lithium cation exchange membrane prepared by the above preparation method in a unit cell having a flow path, and the LEM water electrolysis unit cell was prepared by coupling the LEM water electrolysis unit cell to a single cell. The LEM water electrolysis unit cell was prepared to have the active area of 5 $cm^2$.

<Experimental Example 1> Performance Evaluation for the MEA According to the Present Disclosure In order to check the performance of the lithium cation exchange membrane prepared in Example, 10 wt. % of aqueous lithium hydroxide solution was supplied to both electrodes while constantly maintaining the temperature for the MEA preparation and LEM water electrolysis unit cells at 80° C. At this time, the temperature of the aqueous lithium hydroxide solution was maintained to be the same as that of the unit cell by using a line heater. At a constant temperature, the voltage of the LEM water electrolysis unit cell was gradually increased to 1.4-2.0 V using a DC power supply, and the current applied at each voltage was measured. Graphs showing the measured voltage (V) and current (A) are given in FIGS. 6 and 7, respectively.

FIG. 6 shows a result of electrochemical performance evaluation for the MEA according to Example 1, showing voltage (V) and current (A). In the lithium cation exchange membrane according to Example 1, the lithium cation exchange membrane was prepared using a polymer formed of P123 having an ether group, PVA having an alcohol group, and PS having a sulfonic group among hydrophilic polymers, and it was found that the performance in lithium exchange water electrolysis was increased compared to that of the lithium cation exchange membrane formed of only Nafion. Therefore, according to the present disclosure, it is possible to provide the lithium cation exchange membrane having advanced performance compared to the performance in the conventional lithium cation exchange membrane formed of Nafion.

FIG. 7 shows a result of electrochemical performance evaluation for the MEA according to Example 2, showing voltage (V) and current (A). The lithium cation exchange membrane according to Example 2 is about the electrochemical performance of the lithium cation exchange membrane whose mass ratio of the monomer in which P123 and Nafion (PFSA/PTFE) are included is changed to 2.5-20 wt. %, and it may be noticed that the current density at the same voltage is increased compared to the lithium cation exchange membrane composed of only Nafion, which is a result of increasing reliability in the performance outcome by various conditions. In the case of 2.5 wt. %, the performance at 1.7 V decreased by 0.02 A/$cm^2$, but that at 1.72 V or higher showed the current density increased at the same voltage compared to the lithium cation exchange membrane composed of only Nafion.

In addition, as shown in Table 1 below, the current density of the exchange membrane composed of only Nafion at 1.9V was 1.09 A/$cm^2$ while showing an increase in current density of at least 7% or more which is high current density of 1.61 A/$cm^2$ (current density increased by 48%) when the P123 content was 10 wt. %, exhibiting improved performance compared to the lithium cation exchange membrane formed of only Nafion.

TABLE 1

| | Current density A/$cm^2$ @ 1.7 V | Current density A/$cm^2$ @ 1.9 V |
|---|---|---|
| Nafion D521 | 0.77 | 1.09 |
| P123/N 2.5 | 0.75 | 1.17 |
| P123/N 4.4 | 0.82 | 1.29 |
| P123/N 6.6 | 0.87 | 1.37 |
| P123/N 10.0 | 1.09 | 1.61 |
| P123/N 15.0 | 0.96 | 1.53 |
| P123/N 20.0 | 0.98 | 1.43 |

FIG. 8 shows a result of electrochemical performance evaluation for the MEA according to Example 3, showing voltage (V) and current (A). The lithium cation exchange membrane according to Example 3 is about the electrochemical performance of the lithium cation exchange membrane whose mass ratio of the monomer in which PVA and Nafion™ NR-40 are included was changed to 10-40 wt. %, and it was found that the electrochemical performance increased when the ratio of PVA among PVA and Nafion™ NR-40 increased to 30 wt. %. However, it was found that the electrochemical performance increased as the ratio of PVA among PVA and Nafion™ NR-40 increased, and the electrochemical performance decreased more than 30 wt % in the case of 40 wt % exceeding 30 wt %.

As described above, the improved current density led to an increase in hydrogen production, indicating that the performance was improved by the advanced lithium cation exchange membrane.

<Experimental Example 3> Performance Evaluation According to the Thickness of the MEA According to the Present Disclosure Electrochemical performance according to the thickness of the Nafion membrane prepared only with a D521 solution in Example 2 was evaluated using ultrasonic spray.

As shown in FIG. 9, as a result of preparing the MEA having a thickness of 20 μm using ultrasonic spray, the first IV graph showed high performance exceeding 1 $A/cm^2$ at 1.7 V, but the durability was low due to a decrease in the performance shown in the second, wherein, as a result of preparing the MEA having a thickness of 40 μm using ultrasonic spray, it was found that the durability was high although the electrochemical performance was lower than that of the 20 μm MEA. Accordingly, it was predicted that the performance difference according to the membrane thickness in the sample prepared only with D521 Nafion solution may be applied to the hydrophilic polymer/Nafion membrane.

As described above, a specific part of the content of the present disclosure is described in detail, for those of ordinary skill in the art, it is clear that the specific description is only a preferred embodiment, and the scope of the present disclosure is not limited thereby. Accordingly, the substantial scope of the present disclosure may be defined by the appended claims and their equivalents.

The invention claimed is:

1. A lithium cation exchange membrane (LEM) water electrolysis system, comprising:

a lithium cation exchange membrane including a perfluorosulfonic acid polymer having sulfonic acid groups and a hydrophilic polymer;

an anode catalyst layer on one side of the cation exchange membrane, the anode catalyst layer comprising $Ni_3Co$ alloy nanoparticles, and a cathode catalyst layer on the opposite side of the cation exchange membrane, the cathode catalyst layer comprising nickel-based nanoparticles, wherein an aqueous lithium hydroxide electrolyte is supplied to the anode side and lithium hydroxide is produced at the cathode side during water electrolysis.

2. The LEM water electrolysis system of claim 1, wherein the lithium hydroxide electrolyte is an aqueous solution having a concentration of 1 to 15 wt %.

3. The LEM water electrolysis system of claim 1, wherein the anode and the cathode each comprise an electrode body and a binder in the electrode body.

4. The LEM water electrolysis system of claim 3, wherein the anode catalyst comprises $Ni_3Co$ alloy nanoparticles present in an amount of 1 to 20 wt % relative to 100 wt % of the binder.

5. The LEM water electrolysis system of claim 3, wherein the cathode catalyst comprises nickel based nanoparticles present in an amount of 1 to 20 wt % relative to 100 wt % of the binder.

6. The LEM water electrolysis system of claim 3, wherein the binder is selected from the group consisting of polyvinylidene fluoride, polyvinylidene fluoride-hexafluoropropylene, and combinations thereof.

7. The LEM water electrolysis system of claim 1, wherein the lithium hydroxide produced at the cathode moves to an electrolyte supply reservoir at the anode, thereby providing for reuse of the lithium hydroxide in an anode compartment.

* * * * *